US007581625B2

(12) United States Patent
Cheng

(10) Patent No.: US 7,581,625 B2
(45) Date of Patent: Sep. 1, 2009

(54) CASE WITH HINGE EDGE FRAME ARRANGEMENT

(76) Inventor: Chun Lung Cheng, 1786 Curtiss Ct., La Verne, CA (US) 91750

( * ) Notice: Subject to any disclaimer, the term of this patent is extended or adjusted under 35 U.S.C. 154(b) by 172 days.

(21) Appl. No.: 11/487,286

(22) Filed: Jul. 14, 2006

(65) Prior Publication Data

US 2008/0011744 A1 Jan. 17, 2008

(51) Int. Cl.
*A45C 5/00* (2006.01)
*A45C 13/04* (2006.01)

(52) U.S. Cl. ..... 190/102; 190/24; 190/122

(58) Field of Classification Search ..... 190/11, 190/24, 102, 122, 124–126; 40/546, 548, 40/575, 611.04, 611.12, 792–796; 220/4.22
See application file for complete search history.

(56) References Cited

U.S. PATENT DOCUMENTS

| | | | | | |
|---|---|---|---|---|---|
| D202,250 | S | * | 9/1965 | Hauser | D3/274 |
| 3,352,389 | A | * | 11/1967 | Chubb | 190/123 |
| 3,807,537 | A | * | 4/1974 | O'Reilly | 190/121 |
| 3,833,098 | A | * | 9/1974 | Alderman | 190/11 |
| 4,260,043 | A | * | 4/1981 | Remington | 190/122 |
| 4,274,567 | A | * | 6/1981 | Sawyer | 224/411 |
| 4,770,312 | A | * | 9/1988 | O et al. | 220/4.22 |
| 5,000,301 | A | * | 3/1991 | Grenier | 190/127 |
| 5,007,510 | A | * | 4/1991 | Houng | 190/122 |
| 5,115,893 | A | * | 5/1992 | Terkildsen | 190/11 |
| 5,265,541 | A | * | 11/1993 | Gordon | 108/34 |
| 5,680,973 | A | * | 10/1997 | Vulpitta et al. | 224/153 |
| 6,530,164 | B2 | * | 3/2003 | Gai | 40/546 |
| 6,669,092 | B2 | * | 12/2003 | Leanheart et al. | 235/462.13 |
| 6,823,618 | B2 | * | 11/2004 | Huang | 40/575 |
| 2003/0121740 | A1 | * | 7/2003 | Cheng | 190/25 |

* cited by examiner

*Primary Examiner*—Sue A Weaver
(74) *Attorney, Agent, or Firm*—Raymond Y. Chan; David and Raymond Patent Firm

(57) ABSTRACT

A case, such as a suitcase or a photo case, for holding an object at an exterior thereof includes a case body and a hinge edge frame arrangement. The hinge edge frame arrangement includes a first edge frame, a second edge frame and a resilient element. The first edge frame is extended along the utility edge of the case body to retain a utility panel in position, wherein the first edge frame has an elongated holding slot formed between an outer and an inner wall along a utility edge. The second edge frame includes an elongated pivot arm, having an enlarged end portion, pivotally received in and extended along the holding slot of the first edge frame, and a clipping member extended from the pivot arm, wherein the clipping member is adapted to fold between a clipping position and a releasing position for detachably clipping an object by the clipping member.

16 Claims, 7 Drawing Sheets

CASE WITH HINGE EDGE FRAME ARRANGEMENT

BACKGROUND OF THE PRESENT INVENTION

1. Field of Invention

The present invention relates to a case, and more particularly to a hinge edge frame arrangement for a case, wherein a first edge frame and a second edge frame are extended from a utility edge of a displaying surface of the case for detachably clipping an object on the displaying surface.

2. Description of Related Arts

A conventional case usually comprises a case body defining a receiving cavity, and a case cover pivotally mounted on the case body to selectively enclose the receiving cavity for secure storage of personal belongings in the receiving cavity. Very often, the conventional case further comprises a lock unit operatively coupled on the case body and the corresponding position of the case cover for selectively locking up the case cover with respect to the case body.

Very often, people who use this kind of conventional case need to carry it from one place to another. For example, they may use it for business purpose, so that they will put all the documents into the receiving cavity and retrieve any of them therefrom whenever necessary. A typical scenario is that the user needs to take out some documents from the receiving cavity for writing down some information or actually creating some formal documents. The user may need to issue handwritten invoices to customers or create temporary contracts with his or her clients. Where such scenario occurs, the user needs rigid support for him to write clearly on the documents which he has taken away from the receiving cavity.

An obvious rigid support is the outer hard cover of the case. The user may simply lay down his or her case and put the required documents on top of an outer surface of the case. A major disadvantage of such a practice is that since the user will only use this method when other rigid support (such as a table) is not available, it is very likely that the user is in outdoor environment. As a result, the user will have to hold the document carefully so as to prevent accidental loss of any of them. For example, when the user is writing in a windy environment, he or she has to prevent the documents from being blown away from the outer surface of the case. It is extremely inconvenient for the user to put an additional paper weight on the documents while he or she is writing, for the very reason why the user puts the documents on top of the outer surface of the case is that simply of convenience.

SUMMARY OF THE PRESENT INVENTION

A main object of the present invention is to provide a case comprising a hinge edge frame arrangement, wherein a first edge frame and a second edge frame are extended from a utility edge of a displaying surface of the case for detachably clipping an object (such as a piece of document) on the displaying surface.

Another object of the present invention is to provide a case comprising a hinge edge frame arrangement, wherein the second edge frame is capable of pivotally folding with respect to the first edge frame for clipping on a wide variety of objects on the displaying surface of the case. In other words, the present invention facilitates widespread application thereof.

Another object of the present invention is to provide a case comprising a hinge edge frame arrangement which is light in weight and securely attached on a utility edge of the case so as not to interfere with a normal operation of the case, while allowing a user to securely clip an object onto the displaying surface for, say, temporary working on the documents.

Another object of the present invention is to provide a case comprising a hinge edge frame arrangement which does not involve any complicated and expensive components, so as to minimize the manufacturing cost of the present invention.

Another object of the present invention is to provide a case comprising a hinge edge frame, wherein no pin or axle is needed in the pivot connection of first and second edge frame, so as to prevent the pin or axle from being broken, which is the major and the easiest broken part of the conventional hinge structure.

Another object of the present invention is to provide a case which can be embodied as a wide variety of cases. For example, the present invention can be embodied as a suitcase or a photo case as an alternative.

Accordingly, in order to accomplish the above objects, the present invention provides a case for holding an object at an exterior thereof, comprising:

a case body having a receiving cavity and a utility edge, and comprising a utility panel having a displaying surface extended from the utility edge; and a hinge edge frame arrangement, which comprises:

a first edge frame extended along the utility edge of the case body to retain the utility panel in position, wherein the first edge frame comprises an elongated outer wall and an elongated inner wall defining an elongated holding slot between the outer and inner wall along the utility edge, wherein the outer wall has a closed stopping surface formed at an opening end of the holding slot and an opened stopping surface formed at a closed end of the holding slot;

a second edge frame comprises an elongated pivot arm, having an enlarged end portion, pivotally received in and extended along the holding slot of the first edge frame and a clipping member extended from the pivot arm, wherein the clipping member is adapted to fold between a clipping position and a releasing position, wherein at the clipping position, the clipping member is rested on the displaying surface of the utility panel along the utility edge that the enlarged end portion of the pivot arm is slid in the holding slot to stop at the closed stopping surface thereof, and at the releasing position, the clipping member is pivotally lifted up from the displaying surface of the utility panel that the enlarged end portion of the pivot arm is slid out from the holding slot to stop at the opened stopping surface thereof; and a resilient element coupling with the second edge frame for applying a clipping force to the clipping member to retain the clipping member at the clipping position, such that the clipping member of the second edge frame is adapted for securely holding the object on the utility panel of the case body along the utility edge thereof.

These and other objectives, features, and advantages of the present invention will become apparent from the following detailed description, the accompanying drawings, and the appended claims.

DETAILED DESCRIPTION OF THE PREFERRED EMBODIMENT

Figure 1:
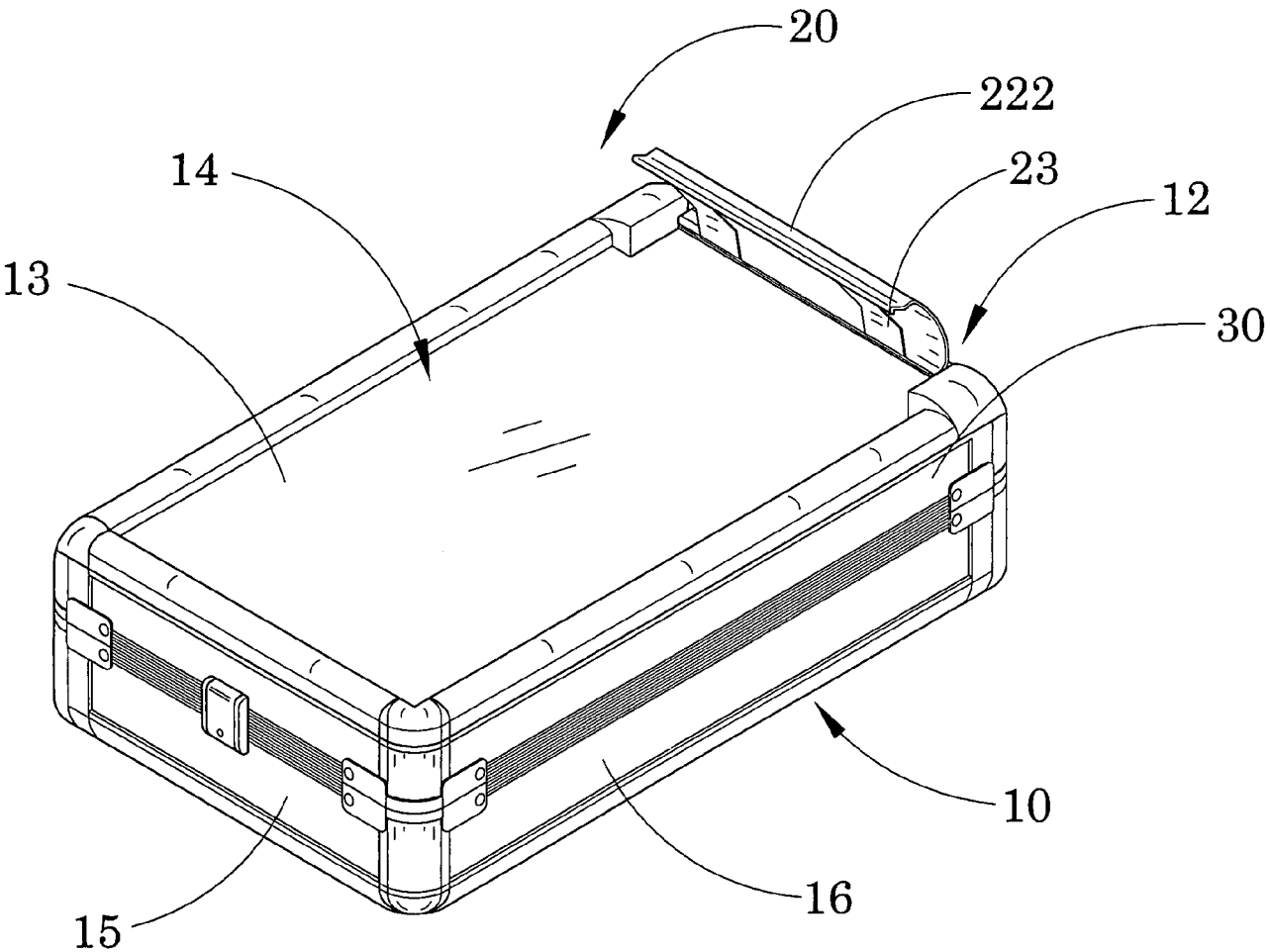
FIG. 1 is a perspective view of a case according to a preferred embodiment of the present invention.

Referring to FIG. 1, FIG. 2A, FIG. 2B, FIG. 3 of the drawings, a case, such as a suitcase, for holding an object at an exterior thereof according to a preferred embodiment of the present invention is illustrated, in which the case comprises a case body 10, and a hinge edge frame arrangement 20.

The case body 10 has a receiving cavity 11 and a utility edge 12, and comprising a utility panel 13 having a displaying surface 14 extended from the utility edge 12.

The hinge edge frame arrangement 20 comprises a first edge frame 21, a second edge frame 22, and a resilient element 23. The first edge frame 21 is extended along the utility edge 12 of the case body 10 to retain the utility panel 13 in position, wherein the first edge frame 21 comprises an elongated outer wall 211 and an elongated inner wall 212 defining an elongated holding slot 213 between the outer and inner wall 211, 212 along the utility edge 12, wherein the outer wall 212 has a closed stopping surface 214 formed at an closed end of the holding slot 213 and an opened stopping surface 215 formed at a opening end of the holding slot 213.

The second edge frame 22 comprises an elongated pivot arm 221, having an arc-shaped body portion 2212 and an enlarged end portion 2211, pivotally received in and extended along the holding slot 213 of the first edge frame 21, and a clipping member 222 extended from the pivot arm 221, wherein the clipping member 222 is adapted to fold between a clipping position and a releasing position, wherein at the clipping position, the clipping member 222 is rested on the displaying surface 14 of the utility panel 13 along the utility edge 12 that the enlarged end portion 2211 of the pivot arm 221 is slid in the holding slot 213 to stop at the closed stopping surface 214 thereof, and at the releasing position, the clipping member 222 is pivotally lifted up from the displaying surface 14 of the utility panel 13 that the enlarged end portion 2211 of the pivot arm 221 is slid out from the holding slot 213 to stop at the opened stopping surface thereof 215.

The resilient element 23 couples with the second edge frame 22 for applying a clipping force to the clipping member 222 to retain the clipping member 222 at the clipping position, such that the clipping member 222 of the second edge frame 22 is adapted for securely holding the object on the utility panel 13 of the case body 10 along the utility edge 12 thereof.

According to the preferred embodiment of the present invention, the case body 10 further comprises an elongated rear panel 15 and two side panels 16, wherein the rear panel 15 and the utility panel 13 are securely connected by the hinge edge frame arrangement 20 for forming the receiving cavity 11 within the rear panel 15, the utility panel 13 and the two side panels 16.

In other words, the case body 10 further comprises the side panel 16 extended from the utility edge 12 to transversely align with the utility panel 13, wherein the first edge frame 21 further comprises two panel connectors 219 securely connecting corresponding edges of the utility panel 13 and the side panel 16 so as to connect the utility panel 13 and the side panel 16 in an edge-to-edge manner along the utility edge 12.

Each of the panel connectors 219 comprises two spaced apart edge connecting walls 2191, wherein the edges of the utility panel 13 and the side panel 16 are securely mounted to the panel connectors 219 between the edge connecting walls 2191 so as to substantially connect the utility panel 13 and the side panel 16 in an edge-to-edge manner.

Accordingly, the first edge frame 21 may further comprises two retention holders downwardly and longitudinally extended from the elongated outer wall 211 and the elongated inner wall 212 to connect with a rear edge of the utility panel 13 and a top edge of the elongated rear panel 15 respectively wherein the utility edge 12 is formed on the utility panel 13, and the second edge frame 22 is allowed to pivotally fold between the clipping position and the releasing position at the utility edge 12 of the case body 10.

Each of the elongated outer wall 211 and the elongated inner wall 212 has an arc-shaped cross section of a predetermined radius of curvature for forming the elongated holding slot 213 having two curved sidewalls as the elongated outer wall 211 and the elongated inner wall 212 respectively, wherein the elongated pivot arm 221 of the second edge frame 22 is adapted to pivotally fold between the clipping position and the releasing position in such a manner to follow the radius of curvature of the elongated outer wall 211 and the elongated inner wall 212. In other words, the elongated pivot arm 221 has a corresponding radius of curvature as that of the elongated inner wall 212 and the elongated outer wall 211 for pivotally moving between the clipping position and the releasing position, wherein the enlarged end portion 2211 is arranged to be pivotally moved to bias against the opened stopping surface 215 when the second edge frame 22 is at the releasing position.

The enlarged end portion 2211 of the pivot arm 221 has two opposed end surfaces forming a first biasing surface 2213 and a second biasing surface 2214 respectively and arranged in such a manner that when the clipping member 222 is folded at the clipping position, the first biasing surface 2213 of the enlarged end portion 2211 of the pivot arm 221 is biased against the closed stopping surface 214 of the holding slot 213, and when the clipping member 222 is folded at the releasing position, the second biasing surface 2214 of the enlarged end portion 2211 of the pivot arm 221 is biased against the opened stopping surface of the holding slot 213.

The second edge frame 22 further comprises a retention arm 224 integrally and outwardly extended from a lower end of the body portion of the pivot arm 221 to define an arc-shaped supporting slot 225 between the pivot arm 221 and the retention arm 224, wherein the outer wall 211 of the first edge frame 21 is shaped and sized to slidably fit in the supporting slot 225, wherein the retention arm 224 has an inner retention surface 2241 and a pivot end 2242 extended from the retention surface 2241 to bias against the outer wall 211 such that the pivot end 2242 of the retention arm 224 forms a pivot point of the second edge frame 22 with respect to the first edge frame 21 to guide the pivot arm 221 to slide within the holding slot 213 while the retention surface 2241 of the retention arm 224 is biased against an outer surface of the outer wall 211 when the clipping member 222 is folded to rest on the displaying surface 14 of the utility panel 13.

In other words, the holding slot 213 has a predetermined curvature to define a traveling distance between the opened stopping surface 215 and the closed stopping surface 214 of the holding slot 213 that allows the pivot arm 221 sliding along that traveling distance between the clipping position and the releasing position of the second edge frame 22.

Moreover, the elongated pivot arm 221 further has a curved outer surface 2212 having a curvature same as a curvature of the elongated inner wall 212 in such a manner that the outer surface 2212 of the pivot arm 221 is fittedly sliding on the inner surface of the inner wall 212 in a frictionally and slidably movable manner.

Figure 2A:
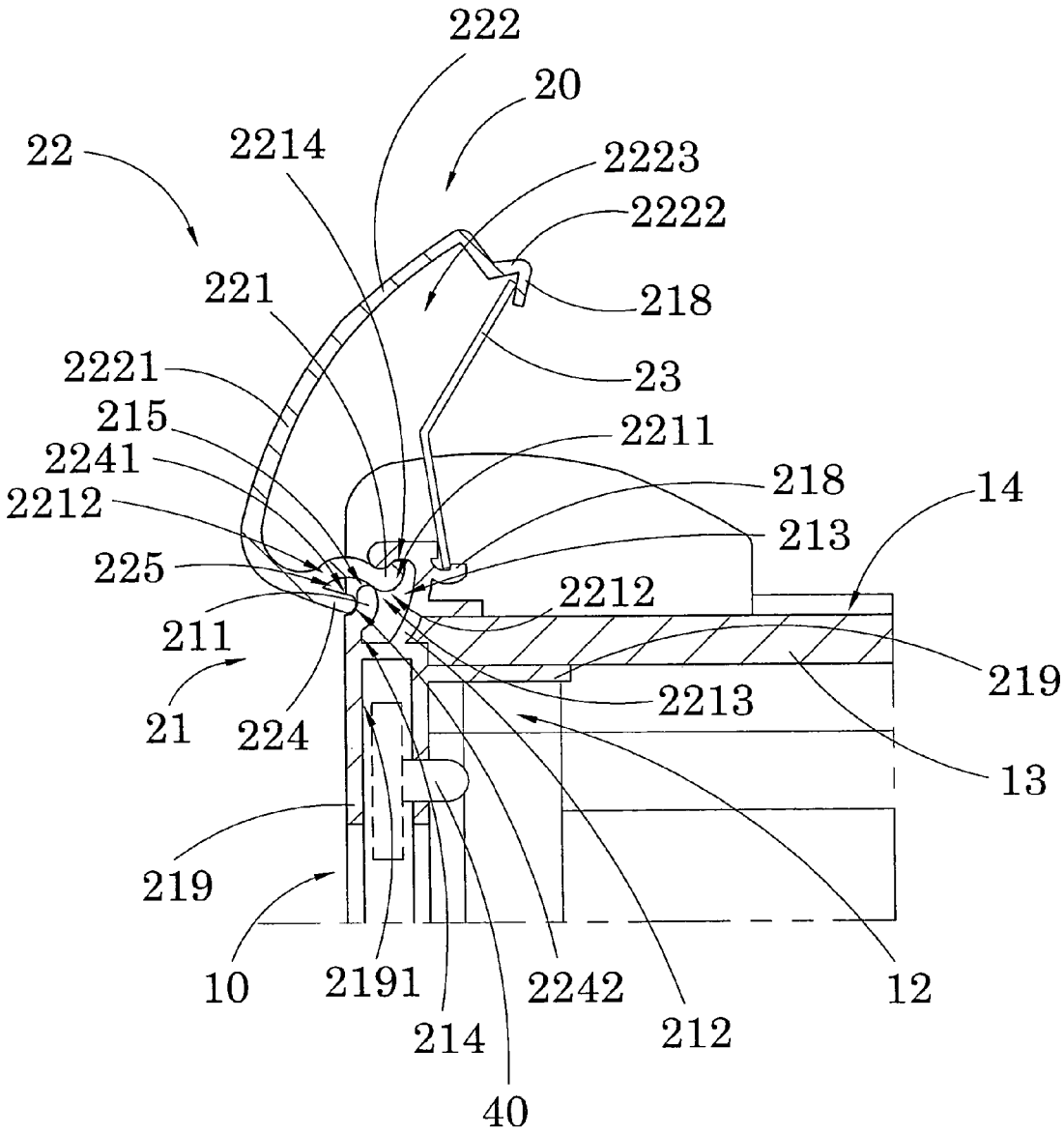
FIG. 2A and FIG. 2C are section side views of a hinge edge frame arrangement according to the above preferred embodiment of the present invention.
Figure 2B:
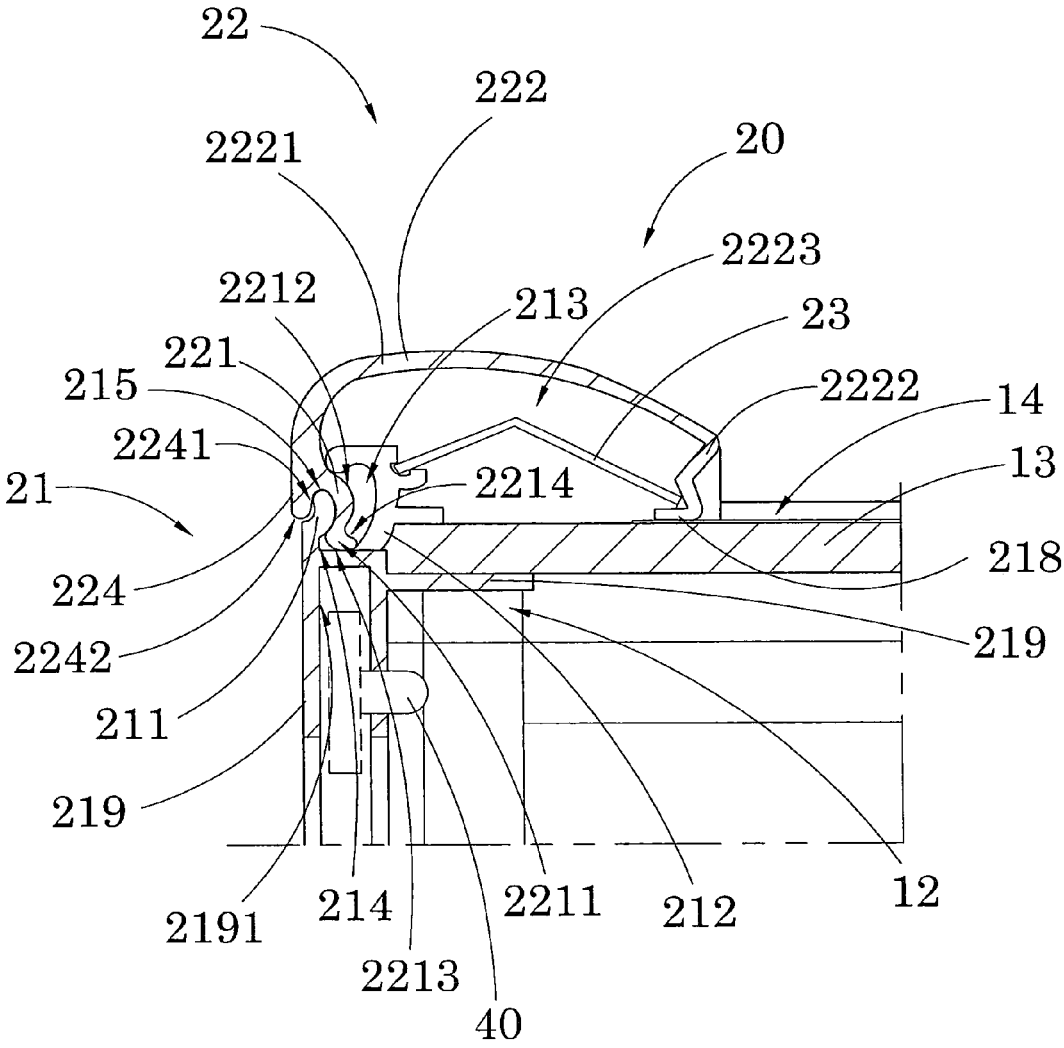

Referring to FIG. 2A and FIG. 2B of the drawings, the hinge edge frame arrangement 20 further comprises two holding rims 218 provided at the inner wall of the first edge frame 21 and the clipping member 222 to securely engage with the urging edges of the resilient element 23 respectively so as to retain the resilient element 23 in position. In other words, the holding rims 218 are extended from the elongated inner wall 212 wherein the resilient element 23 has one urging edge mounted on the second edge frame 22, and another urging edge mounted on the holding rim 218 of the first edge frame 21 which is spacedly apart from the second edge frame 22 for normally exerting a urging force towards the second edge frame 22 so as to normally pull the clipping member 222 towards the displaying surface 14. In other words, the second edge frame 22 is normally kept at its clipping position, wherein an outward pivotal force has to be applied to the clipping member 222 for moving it from the clipping position to the releasing position.

Accordingly, the resilient element 23 comprises a spring clip having two urging edges coupling at the inner wall of the first edge frame 21 and the clipping member 222 respectively for applying the clipping force to the clipping member 222.

The clipping member 222 has an elongated main portion 2221 extended from the elongated pivot arm 221, and a clipping rim 2222 downwardly extended along an inner edge of the elongated main portion 2221 to form a substantially L-shaped structure for defining a clipping cavity 2223 between the elongated main portion 2221 and the clipping rim portion 222, wherein a portion of the object (e.g. the top portion of a piece of paper) is arranged to be retrievably retained within the clipping cavity 2223 when the second edge frame 22 is at the clipping position.

It is worth mentioning that the case body 10 may comprise a plurality of first and the second edge frames 21, 22 provided at sides of the case body 10 for clipping the objects on the displaying surface 14. The operation of the present invention is as follows: the second edge frame 22 is normally retained at the clipping position. When the user wishes to clip something on the displaying surface 14, he or she has to pivotally move the clipping member 222 from the clipping position to the releasing position, and when the clipping member 222 is at the releasing position, the clipping cavity 2223 is exposed to be accessed by the user, so that the user is able to put some objects, such as head portions of documents on the displaying surface 14 at a position aligning with the clipping cavity 2223. Afterwards, the user can simply release the clipping member 222 for allowing it to be pivotally driven by the resilient element 23 to move from the releasing position and the clipping position. The documents are then securely yet detachably clipped on the displaying surface 14. The user is then able to write something thereon with the support of the rigid displaying surface 14.

The hinge edge frame arrangement 20 further comprises a lighting unit 40 provided in the case body 10 for providing illumination towards the displaying surface 14. Accordingly, the utility panel 13 is preferably made of material which is capable of admissible visible light so as to allow illumination of the documents placed on the utility panel 13.

Figure 2C:
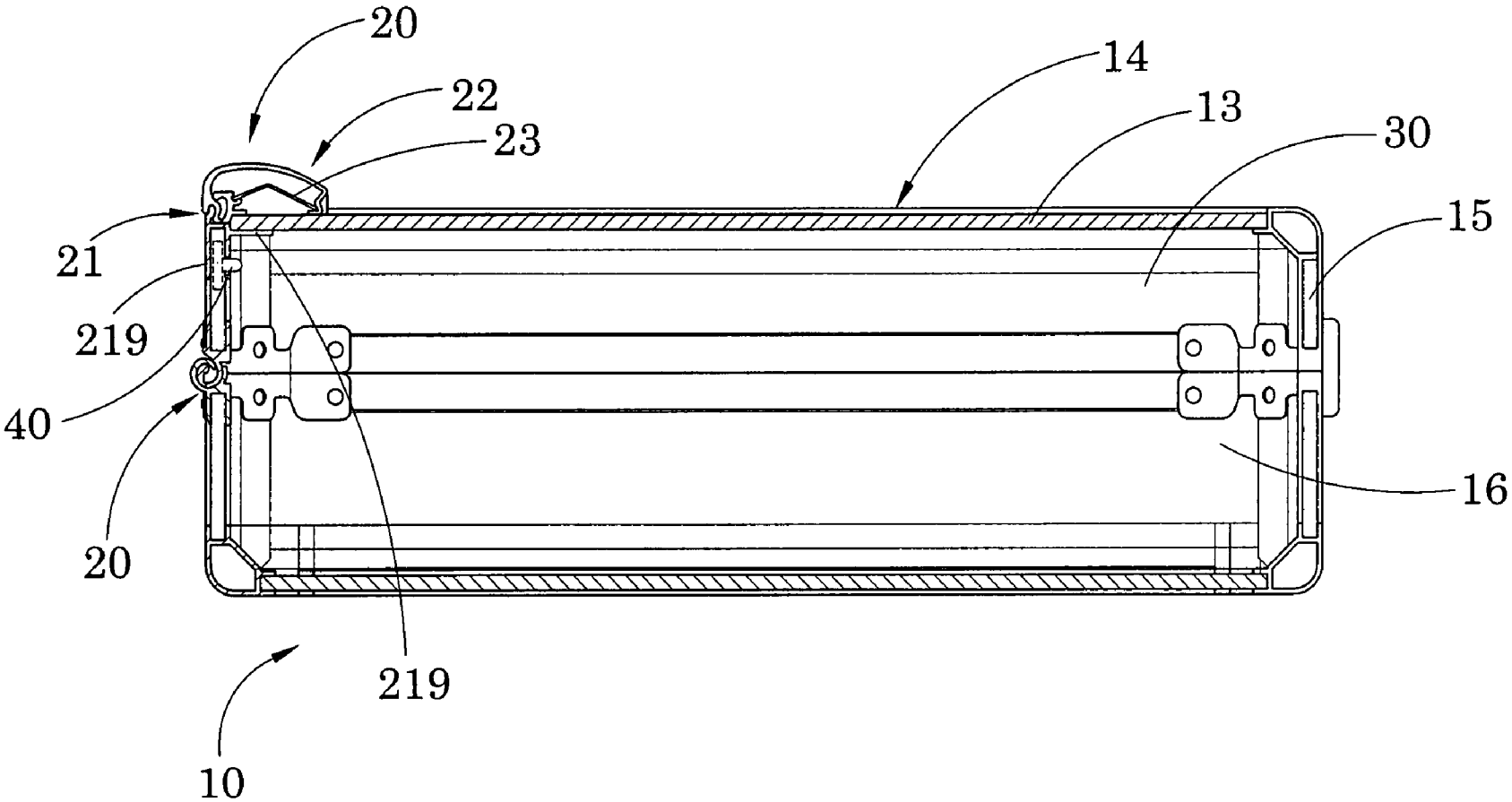
Figure 3:
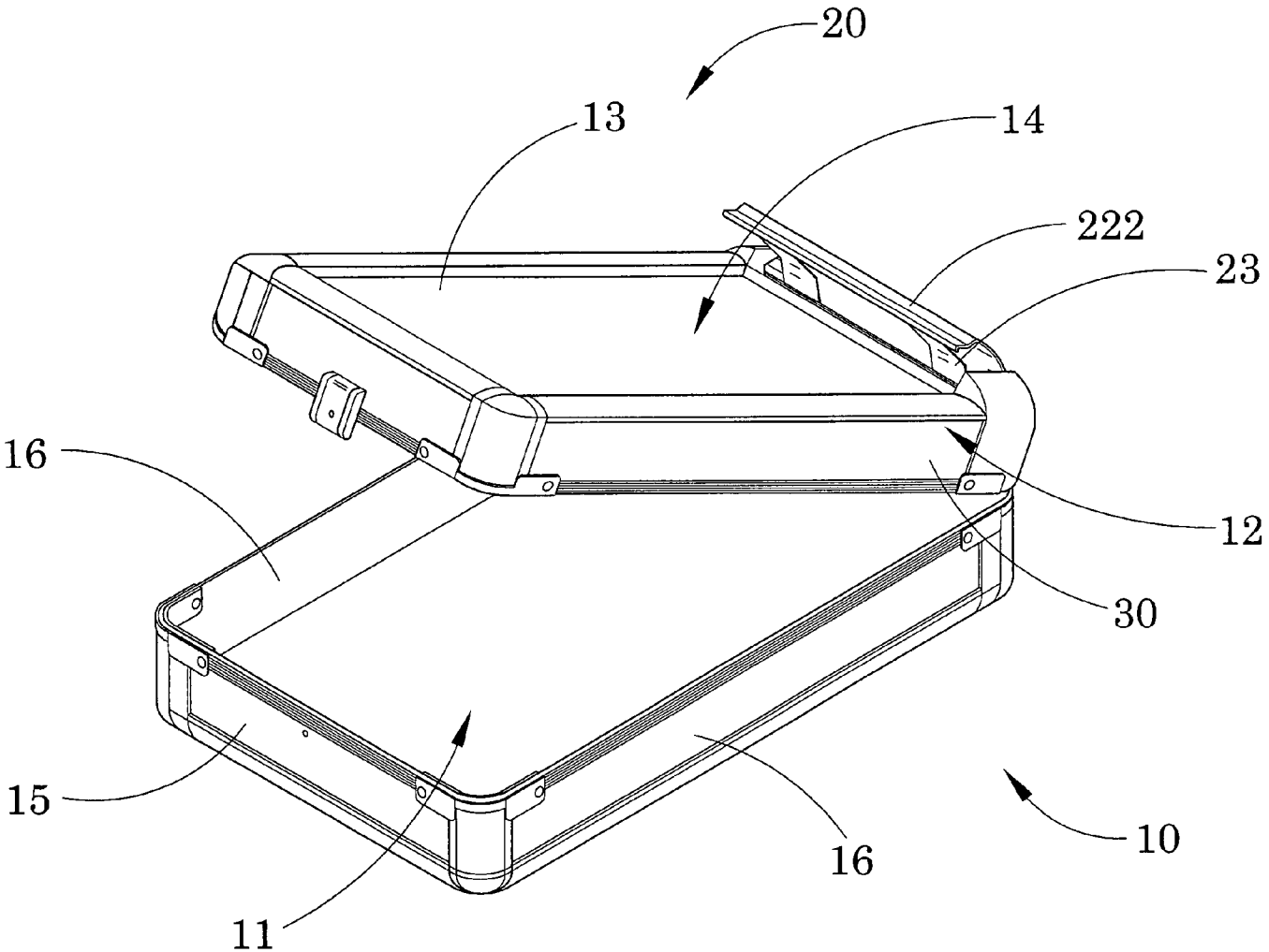
FIG. 3 is a schematic diagram of the case according to the above preferred embodiment of the present invention, illustrating that the case is opened.

Referring to FIG. 2C and FIG. 3 of the drawings, it is noteworthy that the case further comprises a case cover 30 pivotally connected to the case body 10, wherein the pivotal connection between the case cover 30 and the case body 10 is accomplished by the hinge edge frame arrangement 20 as mentioned above. As a result, the case cover 30 is adapted to move between a closed position and an opened position, wherein in the closed position, the case cover 30 is pivotally moved to close the receiving cavity 11 of the case body 10, wherein in the opened position, the case cover 30 is pivotally moved away from the case body 10 so as to expose the receiving cavity 11 to be accessed by the user of the present invention.

Figure 4:
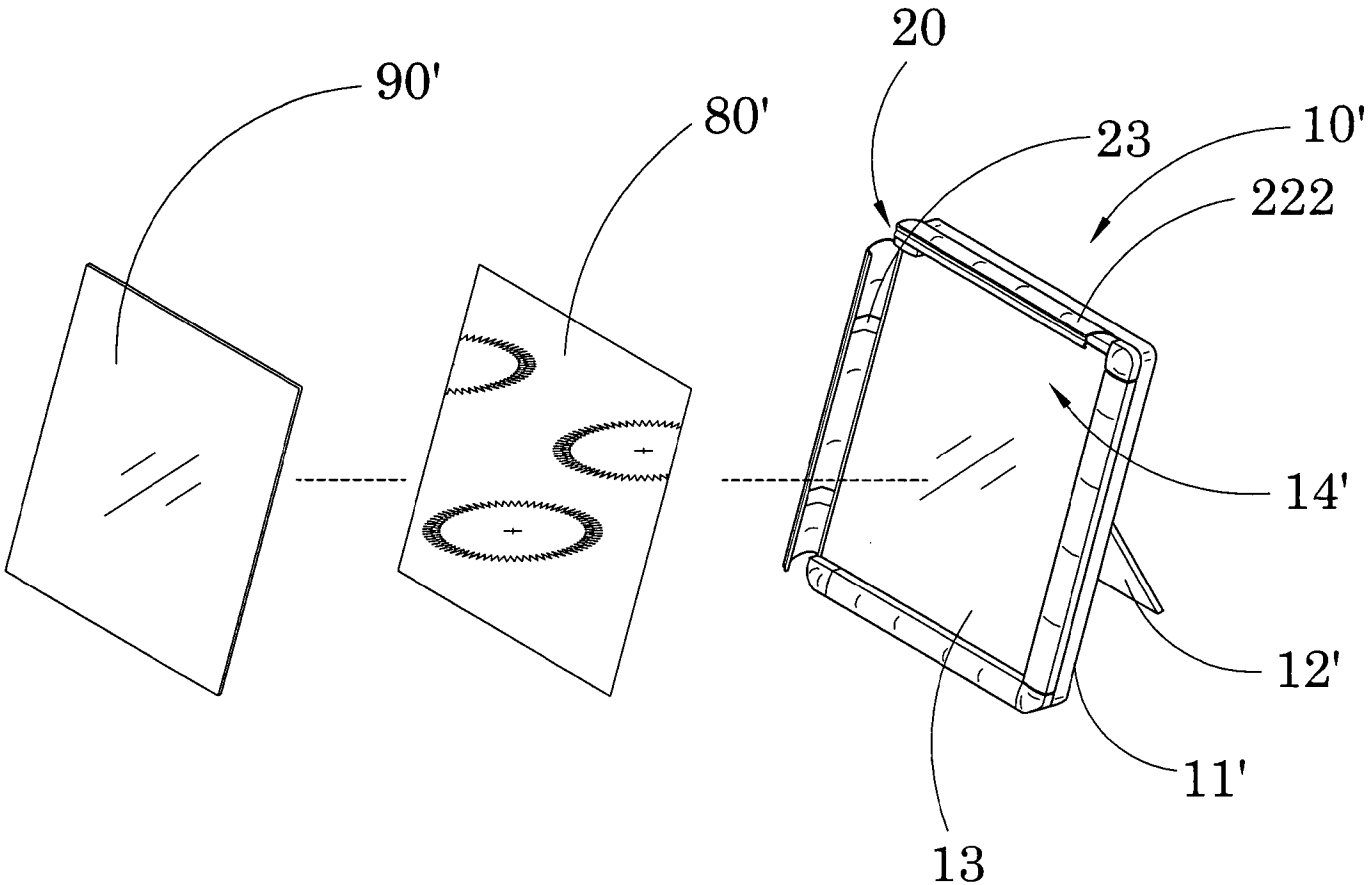
FIG. 4 is an alternative mode of the case according to the above preferred embodiment of the present invention.
Figure 5:
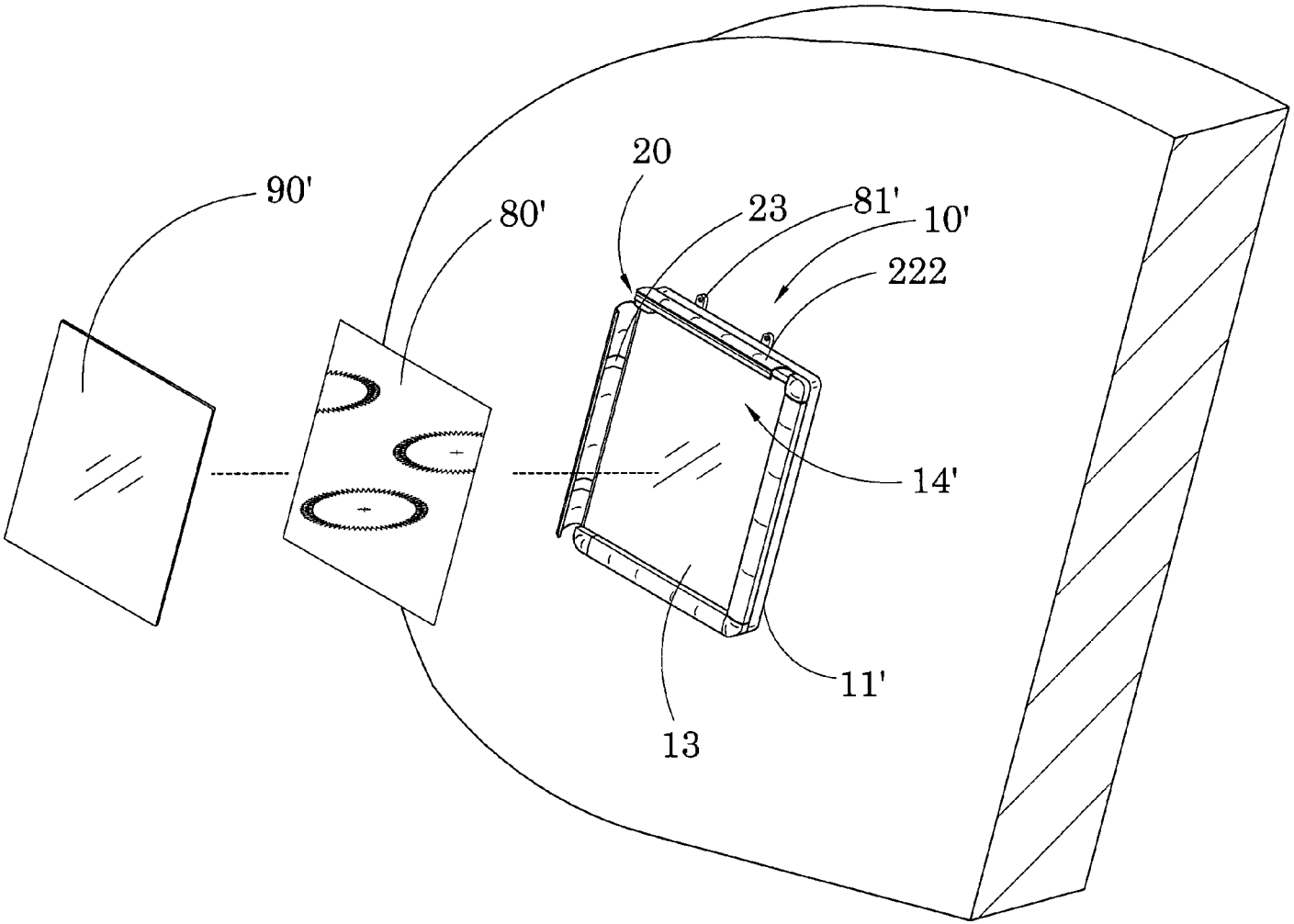
FIG. 5 is a schematic diagram of the alternative mode of the case according to the above preferred embodiment of the present invention.

Referring to FIG. 4 of the drawings, an alternative mode of the hinge edge frame according to the preferred embodiment of the present invention is illustrated. The alternative mode is similar to the preferred embodiment except the case body 10'. According to the alternative mode, the case is embodied as a photo case so that the case body 10' further comprises a main frame panel 11' and a frame support 12' movably mounted at a rear side of the picture frame 11' for supporting a picture shown by the hinge edge frame arrangement 20. As a result, a user able to detachably insert a photo 80' and possible a transparent protective panel 90' when the clipping member 222 is at the releasing position. After the photo 80' and the protective panel 90' have been placed onto the displaying surface 14' of the case body 10', the clipping member 222 will return to the clipping position for securely clipping the photo 80' and the protective panel 90'.

In other words, the case body 10' comprises the main frame panel 11' wherein the hinge edge frame arrangement 20 is operatively provided along the utility edge 12 of the case body 10' to form a photo case of the present invention adapted for holding a photo 80' as the object, wherein the clipping member 222 is adapted to move between the releasing position and the clipping position for selectively holding the photo 80' on the displaying surface 14.

As a slight alternative, the case can be hanged onto a surface, such as a wall, for optimally displaying the photo 80' on the wall. Accordingly, the case further comprises two frame connecting members 81' extended from the case body 10' for being mounted onto the wall by two connectors respectively. As a result, the case can be securely mounted onto the wall for displaying the photo 80', yet it can conveniently replaced by the user from a front side of the case.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A case for holding an object at an exterior thereof, comprising:

a case body, which has a receiving cavity and a utility edge, comprising a utility panel having a displaying surface extended from said utility edge;

a hinge edge frame arrangement, which is provided on said utility edge of said case body, comprising a first edge frame extended along said utility edge of said case body to retain said utility panel in position, and a second edge frame which comprises a clipping member adapted to fold between a clipping position and a releasing position, wherein at said clipping position, said clipping member is rested on said displaying surface of said utility panel along said utility edge adapted for securely clipping the object on said displaying surface, wherein at said releasing position, said clipping member is pivotally lifted up from said displaying surface of said utility panel for allowing replacement of the object on said displaying surface, wherein said first edge frame comprises an elongated supporting arm having an elongated outer wall and an elongated inner wall to form an arc-shaped holding slot therebetween, wherein said inner wall has a closed stopping surface and said outer wall has an opened stopping surface, wherein said second edge frame comprises an elongated pivot arm, having an arc-shaped body portion and an end portion integrally extended therefrom, pivotally received in and extended along said holding slot of said first edge frame and said clipping member extended from said pivot arm, in such a manner that when said clipping member is at said clipping position, said clipping member is rested on said displaying surface of said utility panel along said utility edge that said end portion of said pivot arm is moved in said holding slot to stop at said closed stopping surface thereof, and when said clipping member is at said releasing position, said clipping member is pivotally lifted up from said displaying surface of said utility panel that said body portion of said pivot arm is moved out of said holding slot until said end portion of said pivot arm is moved within said holding slot to be stopped at said opened stopping surface thereof, wherein said second edge frame further comprises a retention arm integrally and outwardly extended from a lower end of said body portion of said pivot arm to define an arc-shaped supporting slot between said pivot arm and said retention arm, wherein said outer wall of said first edge frame is shaped and sized to slidably fit in said supporting slot, wherein said retention arm has an inner retention surface and a pivot end extended from said retention surface to bias against said outer wall such that said pivot end of said retention arm forms a pivot point of said second edge frame with respect to said first edge frame to guide said pivot arm to slide within said holding slot while said retention surface of said retention arm is biased against an outer surface of said outer wall when said clipping member is folded to rest on said displaying surface of said utility panel; and a resilient element coupling with said second edge frame for applying a clipping force to said clipping member to retain said clipping member at said clipping position, such that said clipping member of said second edge frame is adapted for securely holding said object on said utility panel of said case body along said utility edge thereof.

2. A case for holding an object at an exterior thereof, comprising:

a case body, which has a receiving cavity and a utility edge, comprising a utility panel having a displaying surface extended from said utility edge;

a hinge edge frame arrangement, which is provided on said utility edge of said case body, comprising a first edge frame extended along said utility edge of said case body to retain said utility panel in position, and a second edge frame which comprises a clipping member adapted to fold between a clipping position and a releasing position, wherein at said clipping position, said clipping member is rested on said displaying surface of said utility panel along said utility edge adapted for securely clipping the object on said displaying surface, wherein at said releasing position, said clipping member is pivotally lifted up from said displaying surface of said utility panel for allowing replacement of the object on said displaying surface, wherein said first edge frame comprises an elongated supporting arm having an elongated outer wall and an elongated inner wall to form an arc-shaped holding slot therebetween, wherein said inner wall has a closed stopping surface and said outer wall has an opened stopping surface, wherein said second edge frame comprises an elongated pivot arm, having an arc-shaped body portion and an end portion integrally extended therefrom, pivotally received in and extended along said holding slot of said first edge frame and said clipping member extended from said pivot arm, in such a manner that when said clipping member is at said clipping position, said clipping member is rested on said displaying surface of said utility panel along said utility edge that said end portion of said pivot arm is moved in said holding slot to stop at said closed stopping surface thereof, and when said clipping member is at said releasing position, said clipping member is pivotally lifted up from said displaying surface of said utility panel that said body portion of said pivot arm is moved out of said holding slot until said end portion of said pivot arm is moved within said holding slot to be stopped at said opened stopping surface thereof, wherein said end portion of said pivot arm has two opposed end surfaces forming a first biasing surface and a second biasing surface respectively and arranged in such a manner that when said clipping member is folded at said clipping position, said first biasing surface of said end portion of said pivot arm is biased against said closed stopping surface of said holding slot, and when said clipping member is folded at said releasing position, said second biasing surface of said end portion of said pivot arm is biased against said opened stopping surface of said holding slot, wherein said second edge frame further comprises a retention arm integrally and outwardly extended from a lower end of said body portion of said pivot arm to define an arc-shaped supporting slot between said pivot arm and said retention arm, wherein said outer wall of said first edge frame is shaped and sized to slidably fit in said supporting slot, wherein said retention arm has an inner retention surface and a pivot end extended from said retention surface to bias against said outer wall such that said pivot end of said retention arm forms a pivot point of said second edge frame with respect to said first edge frame to guide said pivot arm to slide within said holding slot while said retention surface of said retention arm is biased against an outer surface of said outer wall when said clipping member is folded to rest on said displaying surface of said utility panel; and a resilient element coupling with said second edge frame for applying a clipping force to said clipping member to retain said clipping member at said clipping position, such that said clipping member of said second edge frame is adapted for securely holding said object on said utility panel of said case body along said utility edge thereof.

3. The case, as recited in claim 2, wherein said holding slot has a predetermined curvature to define a traveling distance between said opened stopping surface and said closed stopping surface of said holding slot that allows said pivot arm to slide along said traveling distance between said clipping position and said releasing position of said second edge frame.

4. The case, as recited in claim 2, wherein said resilient element comprises a spring clip having two urging edges coupling at said inner wall of said first edge frame and said clipping member respectively for applying said clipping force to said clipping member.

5. The case, as recited in claim 3, wherein said resilient element comprises a spring clip having two urging edges coupling at said inner wall of said first edge frame and said clipping member respectively for applying said clipping force to said clipping member.

6. The case, as recited in claim 5, wherein said hinge edge frame arrangement further comprises two holding rims provided at said inner wall of said first edge frame and said clipping member to securely engage with said urging edges of said resilient element respectively so as to retain said resilient element in position.

7. The case, as recited in claim 3, wherein said clipping member, which is integrally extended from said pivot arm, has an elongated clipping rim biasing on said displaying surface of said utility panel for securely holding said item between said clipping rim of said clipping member and said displaying surface of said utility panel by means of said clipping force.

8. The case, as recited in claim 6, wherein said clipping member, which is integrally extended from said pivot arm, has an elongated clipping rim biasing on said displaying surface of said utility panel for securely holding said item between said clipping rim of said clipping member and said displaying surface of said utility panel by means of said clipping force.

9. The case, as recited in claim 3, wherein said case body further comprises a side panel extended from said utility edge to transversely align with said utility panel, wherein said first edge frame further comprises two panel connectors securely connecting corresponding edges of said utility panel and said side panel.

10. The case, as recited in claim 8, wherein said case body further comprises a side panel extended from said utility edge to transversely align with said utility panel, wherein said first edge frame further comprises two panel connectors securely connecting corresponding edges of said utility panel and said side panel.

11. The case, as recited in claim 9, wherein each of said panel connectors comprises two spaced apart edge connecting walls, wherein said edges of said utility panel and said side panel are securely mounted to said panel connectors between said edge connecting walls.

12. The case, as recited in claim 10, wherein each of said panel connectors comprises two spaced apart edge connecting walls, wherein said edges of said utility panel and said side panel are securely mounted to said panel connectors between said edge connecting walls.

13. The case, as recited in claim 7, wherein said case body comprises a main frame panel wherein said hinge edge frame arrangement is operatively provided along said utility edge of said case body to form a photo case adapted for holding a photo as said object, wherein said clipping member is adapted to moving between said releasing position and said clipping position for selectively holding said photo on said displaying surface.

14. The case, as recited in claim 8, wherein said case body comprises a main frame panel wherein said hinge edge frame arrangement is operatively provided along said utility edge of said case body to form a photo case adapted for holding a photo as said object, wherein said clipping member is adapted to moving between said releasing position and said clipping position for selectively holding said photo on said displaying surface.

15. A case for holding an object at an exterior thereof, comprising:

a case body, which has a receiving cavity and a utility edge, comprising a utility panel having a displaying surface extended from said utility edge;

a hinge edge frame arrangement, which is provided on said utility edge of said case body, comprising a first edge frame extended along said utility edge of said case body to retain said utility panel in position, and a second edge frame which comprises a clipping member adapted to fold between a clipping position and a releasing position, wherein at said clipping position, said clipping member is rested on said displaying surface of said utility panel along said utility edge adapted for securely clipping the object on said displaying surface, wherein at said releasing position, said clipping member is pivotally lifted up from said displaying surface of said utility panel for allowing replacement of the object on said displaying surface, wherein said first edge frame comprises an elongated supporting arm having an elongated outer wall and an elongated inner wall to form an arc-shaped holding slot therebetween, wherein said inner wall has a closed stopping surface and said outer wall has an opened stopping surface, wherein said second edge frame comprises an elongated pivot arm, having an arc-shaped body portion and an end portion integrally extended therefrom, pivotally received in and extended along said holding slot of said first edge frame and said clipping member extended from said pivot arm, in such a manner that when said clipping member is at said clipping position, said clipping member is rested on said displaying surface of said utility panel along said utility edge that said end portion of said pivot arm is moved in said holding slot to stop at said closed stopping surface thereof, and when said clipping member is at said releasing position, said clipping member is pivotally lifted up from said displaying surface of said utility panel that said body portion of said pivot arm is moved out of said holding slot until said end portion of said pivot arm is moved within said holding slot to be stopped at said opened stopping surface thereof, wherein said end portion of said pivot arm has two opposed end surfaces forming a first biasing surface and a second biasing surface respectively and arranged in such a manner that when said clipping member is folded at said clipping position, said first biasing surface of said end portion of said pivot arm is biased against said closed stopping surface of said holding slot, and when said clipping member is folded at said releasing position, said second biasing surface of said end portion of said pivot arm is biased against said opened stopping surface of said holding slot, wherein said holding slot has a predetermined curvature to define a traveling distance between said opened stopping surface and said closed stopping surface of said holding slot that allows said pivot arm to slide along said traveling distance between said clipping position and said releasing position of said second edge frame; and a resilient element coupling with said second edge frame for applying a clipping force to said clipping member to retain said clipping member at said clipping position, such that said clipping member of said second edge frame is adapted for securely holding said object on said utility panel of said case body along said utility edge thereof.

16. A case for holding an object at an exterior thereof, comprising:

a case body, which has a receiving cavity and a utility edge, comprising a utility panel having a displaying surface extended from said utility edge and a side panel extended from said utility edge to transversely align with said utility panel;

a hinge edge frame arrangement, which is provided on said utility edge of said case body, comprising a first edge frame extended along said utility edge of said case body to retain said utility panel in position, and a second edge frame which comprises a clipping member adapted to fold between a clipping position and a releasing position, wherein said first edge frame further comprises two panel connectors securely connecting corresponding edges of said utility panel and said side panel, wherein each of said panel connectors comprises two spaced apart edge connecting walls, wherein said edges of said utility panel and said side panel are securely mounted to said panel connectors between said edge connecting walls, wherein at said clipping position, said clipping member is rested on said displaying surface of said utility panel along said utility edge adapted for securely clipping the object on said displaying surface, wherein at said releasing position, said clipping member is pivotally lifted up from said displaying surface of said utility panel for allowing replacement of the object on said displaying surface, wherein said first edge frame comprises an elongated supporting arm having an elongated outer wall and an elongated inner wall to form an arc-shaped holding slot therebetween, wherein said inner wall has a closed stopping surface and said outer wall has an opened stopping surface, wherein said second edge frame comprises an elongated pivot arm, having an arc-shaped body portion and an end portion integrally extended therefrom, pivotally received in and extended along said holding slot of said first edge frame and said clipping member extended from said pivot arm, in such a manner that when said clipping member is at said clipping position, said clipping member is rested on said displaying surface of said utility panel along said utility edge that said end portion of said pivot arm is moved in said holding slot to stop at said closed stopping surface thereof, and when said clipping member is at said releasing position, said clipping member is pivotally lifted up from said displaying surface of said utility panel that said body portion of said pivot arm is moved out of said holding slot until said end portion of said pivot arm is moved within said holding slot to be stopped at said opened stopping surface thereof; and a resilient element coupling with said second edge frame for applying a clipping force to said clipping member to retain said clipping member at said clipping position, such that said clipping member of said second edge frame is adapted for securely holding said object on said utility panel of said case body along said utility edge thereof.

* * * * *